US006740863B2

(12) United States Patent
Sawyer et al.

(10) Patent No.: US 6,740,863 B2
(45) Date of Patent: May 25, 2004

(54) JOYSTICK

(75) Inventors: Anthony M. Sawyer, Basingstoke (GB); David J. Johns, Basingstoke (GB)

(73) Assignee: Advanced Input Devices (UK) Limited, Hampshire (GB)

( * ) Notice: Subject to any disclaimer, the term of this patent is extended or adjusted under 35 U.S.C. 154(b) by 0 days.

(21) Appl. No.: 10/324,128

(22) Filed: Dec. 20, 2002

(65) Prior Publication Data

US 2003/0116700 A1 Jun. 26, 2003

(30) Foreign Application Priority Data

Dec. 20, 2001 (GB) ..... 0130500.2

(51) Int. Cl.[7] ..... G09G 5/08
(52) U.S. Cl. ..... 250/221; 345/161
(58) Field of Search ..... 250/221, 222.1, 250/216, 229, 208.6; 345/157, 158, 161, 163, 164, 165, 166

(56) References Cited

U.S. PATENT DOCUMENTS

| | | | | |
|---|---|---|---|---|
| 4,520,355 A | | 5/1985 | Mitch | |
| 4,533,827 A | | 8/1985 | Fincher | |
| 4,587,510 A | | 5/1986 | Kim | |
| 5,223,709 A | | 6/1993 | Pettypiece, Jr. | |
| 5,288,993 A | | 2/1994 | Bidiville et al. | |
| 5,578,817 A | | 11/1996 | Bidiville et al. | |
| 5,703,356 A | | 12/1997 | Bidiville et al. | |
| 5,729,009 A | | 3/1998 | Dandliker et al. | |
| 5,854,482 A | | 12/1998 | Bidiville et al. | |
| 5,907,152 A | | 5/1999 | Dandliker et al. | |
| 6,031,218 A | | 2/2000 | Piot et al. | |
| 6,084,574 A | | 7/2000 | Bidiville | |
| 6,124,587 A | | 9/2000 | Bidiville et al. | |
| 6,130,424 A | * | 10/2000 | Mikan | 250/227.22 |
| 6,218,659 B1 | | 4/2001 | Bidiville et al. | |
| 6,222,179 B1 | * | 4/2001 | Mikan | 250/221 |
| 6,225,617 B1 | | 5/2001 | Dandliker et al. | |

FOREIGN PATENT DOCUMENTS

| | | |
|---|---|---|
| GB | 1523679 | 9/1978 |
| GB | 2271847 A | 4/1994 |
| JP | 61-276015 | 12/1986 |
| JP | 06-187093 | 7/1994 |

* cited by examiner

*Primary Examiner*—Kevin Pyo
(74) *Attorney, Agent, or Firm*—Nixon & Vanderhye P.C.

(57) ABSTRACT

A joystick 50 comprising: a control shaft 52; first and second reflecting surfaces, the surfaces each having a reflectivity that varies along a notional line on the surface; a first sensor assembly 70 comprising a first emitter operable to illuminate the first reflecting surface along said line with radiation, and a first detector arranged to detect radiation emitted by the first emitter and reflected by the first reflecting surface; and a second sensor assembly 72 comprising a second emitter operable to illuminate the second reflecting surface along the line with radiation, and a second detector arranged to detect radiation emitted by the second emitter and reflected by the second reflecting surface; wherein movement of said shaft 52 provides a relative movement between emitters of the first and/or second sensor assemblies 70, 72 and respective associated reflecting surfaces to vary the intensity of radiation reflected, and the detectors of the first and second sensor assemblies are each operable to output a voltage that is dependent on the intensity of radiation detected.

16 Claims, 7 Drawing Sheets

*Fig. 2* *(Prior Art)*

JOYSTICK

FIELD OF THE INVENTION

This invention relates to joysticks, and in particular to optical joysticks.

DESCRIPTION OF THE PRIOR ART

Joysticks are used for a variety of purposes in a variety of different circumstances. For example they are used in computer systems to control the position of a pointer on a screen, as well as being used in a variety of vehicles (such as a helicopter for example) to control the direction of motion of the vehicle.

Whilst a variety of different types of joystick have previously been proposed, they all share a number of common features. For example, all joysticks have a shaft which can be gripped at one end by a user and pivoted about a fixed point in (at least) a two dimensional (X and Y) space. Coupled to the other end of the shaft is some sort of control system which is operable to convert movement of the shaft in the space into electrical signals.

The earliest joysticks were mechanical joysticks, so called because they used a part-mechanical control system to convert movement of the shaft into electrical signals. FIG. 1 is a cross-sectional view through the base of one such mechanical joystick. As shown, the joystick 1 includes a pair of potentiometers 10, 12 which are mounted on a common frame 14. A shaft 16 is provided, and one end of the shaft is coupled to a stationary member (such as the floor of the joystick) by a universal joint so that the other end of the shaft 16 can move in both X and Y directions. The control shafts of the potentiometers 10 and 12 are coupled to the shaft 16 by respective arm members 18 and 20 which each include an elongated opening 22, 24.

As the shaft is moved in the X direction it bears against the arm member 20 (without bearing on the other arm 18) and causes it to tilt about its axis. As the arm 20 tilts it rotates the control shaft of the potentiometer 12, and so varies the resistance of that potentiometer. The change in resistance of the potentiometer 12 is directly proportional to the extent to which the control shaft is rotated and thus provides an accurate means to measure the amount of shaft deflection in the X direction.

In a similar fashion, if the shaft is moved in the Y direction it bears against the arm member 18 (without bearing on the arm 20) and causes it to tilt about its axis to vary the resistance of the potentiometer 10 connected thereto.

As will be apparent from FIG. 1, if the joystick is moved in directions other than along the X or Y axes, then both potentiometers 10 and 12 will be rotated simultaneously and the exact position of the shaft in the space can be read out based on the relative resistances of the two potentiometers.

A problem with this previously proposed joystick is that as the potentiometers are mechanical devices, they are subject to wear and as a result will eventually fail. When this happens the potentiometers must be replaced if the user wishes to avoid having to purchase a new joystick. Another problem is that the greased control shafts of the potentiometers tend to attract fluff and other detritus which can impair smooth rotation of the control shafts.

To alleviate these problems it has previously been proposed, in United Kingdom Patent Application No. 2334573 for example, to use optical components which are free from the problems which typically face corresponding mechanical components.

FIG. 2 illustrates the joystick described in UK Patent Application No. 2334573. As shown, the shaft 2, 5 of the joystick 1 includes an optical emitter 3 which is adapted to illuminate a bank of optical detectors 9, 10, 11, 12 arranged on the floor of the joystick. As the shaft is moved about the two-dimensional space the emitter illuminates each of the detectors to a different degree, and hence the quantity of light detected by each of the detectors 9, 10, 11 and 12 varies. As the quantity (or intensity) of detected light varies the electrical signals output from the detectors also vary. Control electronics (not shown) interpret the signals output from the detectors to compute the position of the shaft in the space.

Whilst the joystick of FIG. 2 avoids the problems associated with the joystick of FIG. 1, it has its own set of disadvantages.

A first of these is associated with the fact that each of the detectors tend to detect an amount of light which can vary only to a small extent from that received by neighbouring detectors. As a result of this, the control electronics need to be quite sophisticated and carefully designed to enable position information to be accurately determined.

A further problem with the joystick of FIG. 2, and indeed with that of FIG. 1, is that it is not easy to adapt the joystick to provide anything other than a linear response between shaft movement and signal output. One might want to do this, for example, if the joystick is to be used in a computer system for handicapped or otherwise disabled users where it would be useful for the joystick to have a response where the effect of involuntary hand movements (such as a tremor for example) on cursor movement is reduced. Similarly, a non-linear response would assist those persons who only have a relatively poor amount of movement to control the position of a cursor on a screen.

U.S. Pat. No. 4,533,827 discloses another optical joystick which alleviates the first mentioned problem associated with the joystick of FIG. 2. As shown in FIG. 3, the joystick proposed in this U.S. patent employs a number of emitter/detector pairs 20–26 spaced about the periphery of a central sphere 18. The outside surface of the sphere is painted so that it varies smoothly from being wholly reflective (for example at the top of the sphere) to being wholly non-reflective (for example at the bottom of the sphere). As the joystick of FIG. 3 is moved, the sphere moves with it, and the quantity of light detected by each of the detectors varies accordingly. Since the emitter/detector pairs of the joystick of FIG. 3 are separated from one another, it is unlikely that illumination from any one emitter will have any real effect upon any other detector outside of its emitter/detector pair.

However, a major disadvantage of the joystick shown in FIG. 3 is that as the sphere goes from reflective to non-reflective in front of one emitter/detector pair, it will tend to go from non-reflective to reflective in front of the other emitter/detector pair. This disadvantage is exacerbated if the reflectivity of the sphere varies non-linearly.

The only way to avoid this disadvantage of the joystick shown in FIG. 3 is to adapt the control electronics so that one emitter/detector pair output is inverse to that of the other. This complicates the control electronics of the joystick, and hence increases the cost of the joystick.

The present invention has been conceived with the aim of alleviating the above-described problems.

STATEMENT OF INVENTION

In pursuit of this aim, one embodiment of the invention provides a joystick comprising: a control shaft; first and second reflecting surfaces, said surfaces each having a reflectivity that varies along a notional line on said surface; a first sensor assembly comprising a first emitter operable to illuminate said first reflecting surface along said line with radiation, and a first detector arranged to detect radiation emitted by said first emitter and reflected by said first reflecting surface; and a second sensor assembly comprising a second emitter operable to illuminate said second reflecting surface along said line with radiation, and a second detector arranged to detect radiation emitted by said second emitter and reflected by said second reflecting surface; wherein movement of said shaft provides a relative movement between emitters of the first and/or second sensor assemblies and respective associated reflecting surfaces to vary the intensity of radiation reflected, and said detectors of said first and second sensor assemblies are each operable to output a voltage that is dependent on the intensity of radiation detected.

The joystick of this embodiment is advantageous over joysticks of the type shown in FIG. 1 because of the fact that the optical movement detection system is free from the problems that are characteristic of prior art mechanical joysticks. Furthermore, as the detector/emitter pairs are well spaced from one another so the likelihood of light from one emitter being detected by the detector of the other emitter/detector pair is significantly reduced, and thus the joystick of this embodiment is advantageous over the joystick of FIG. 2.

The joystick of this embodiment is also advantageous over the joystick shown in FIG. 3 because of the fact that the control electronics do not need to be designed to compensate for outputs which vary in the opposite sense from one another. Unusually (and indeed contrary to normal expectations in the art) the joystick of this embodiment also provides advantages which result from the fact that it is more complicated than prior art optical joysticks of the type shown in FIG. 3. In particular, by increasing the number of reflecting surfaces it is possible to more easily provide different non-linear reflectivity variations. This is something that one might realistically want to do in circumstances where the user of the joystick is physically impaired only in one direction of movement.

In accordance with a further embodiment of the invention, there is provided a joystick comprising: a control shaft moveable throughout a two dimensional space defined by X and Y axes; first and second reflectors each having a surface with a reflectivity that varies along one axis of the reflector; a first sensor assembly comprising a first emitter operable to illuminate portions of said first reflector surface with a beam of radiation, and a first detector arranged to detect radiation emitted by said first emitter and reflected by said first reflector surface; a second sensor assembly comprising a second emitter operable to illuminate portions of said second reflector surface with a beam of radiation, and a second detector arranged to detect radiation emitted by said second emitter and reflected by said second reflector surface; and means for transforming movement of the shaft into relative movement between emitters of the first and/or second sensor assemblies and respective associated reflectors; wherein said transform means is operable: on movement of said shaft along said X axis to establish a relative movement which causes said beam of said first emitter to track generally along said first reflector axis; on movement of said shaft along said Y axis to establish a relative movement which causes said beam of said second emitter to track generally along said second reflector axis; and on any other movement of said shaft to establish a relative movement which causes said beam of said first and second emitters to track generally along said first and second reflector axes, respectively.

Other advantages of embodiments of the invention will be apparent once the following description has been read and understood.

BRIEF DESCRIPTION OF THE DRAWINGS

Embodiments of the invention will now be described, by way of example only, with reference to the accompanying drawings, in which.

DETAILED DESCRIPTION OF PREFERRED EMBODIMENTS

Figure 1:
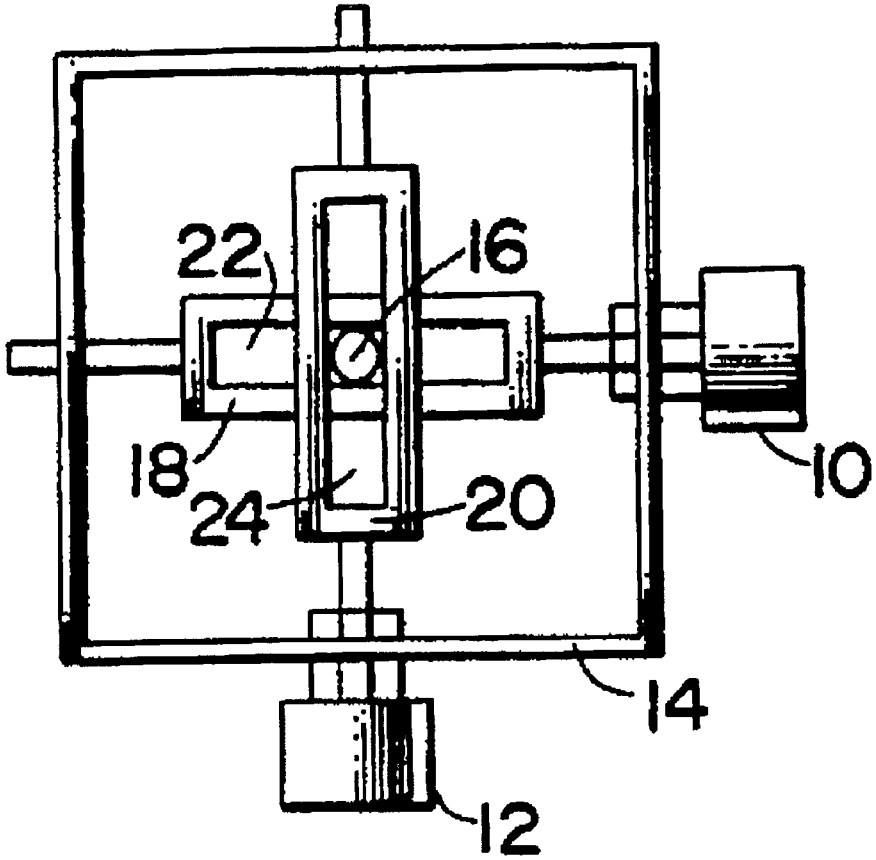
Fig. 1 (Prior Art)
FIGS. 1 to 3 are schematic representations of previously proposed joysticks.
Figure 2:
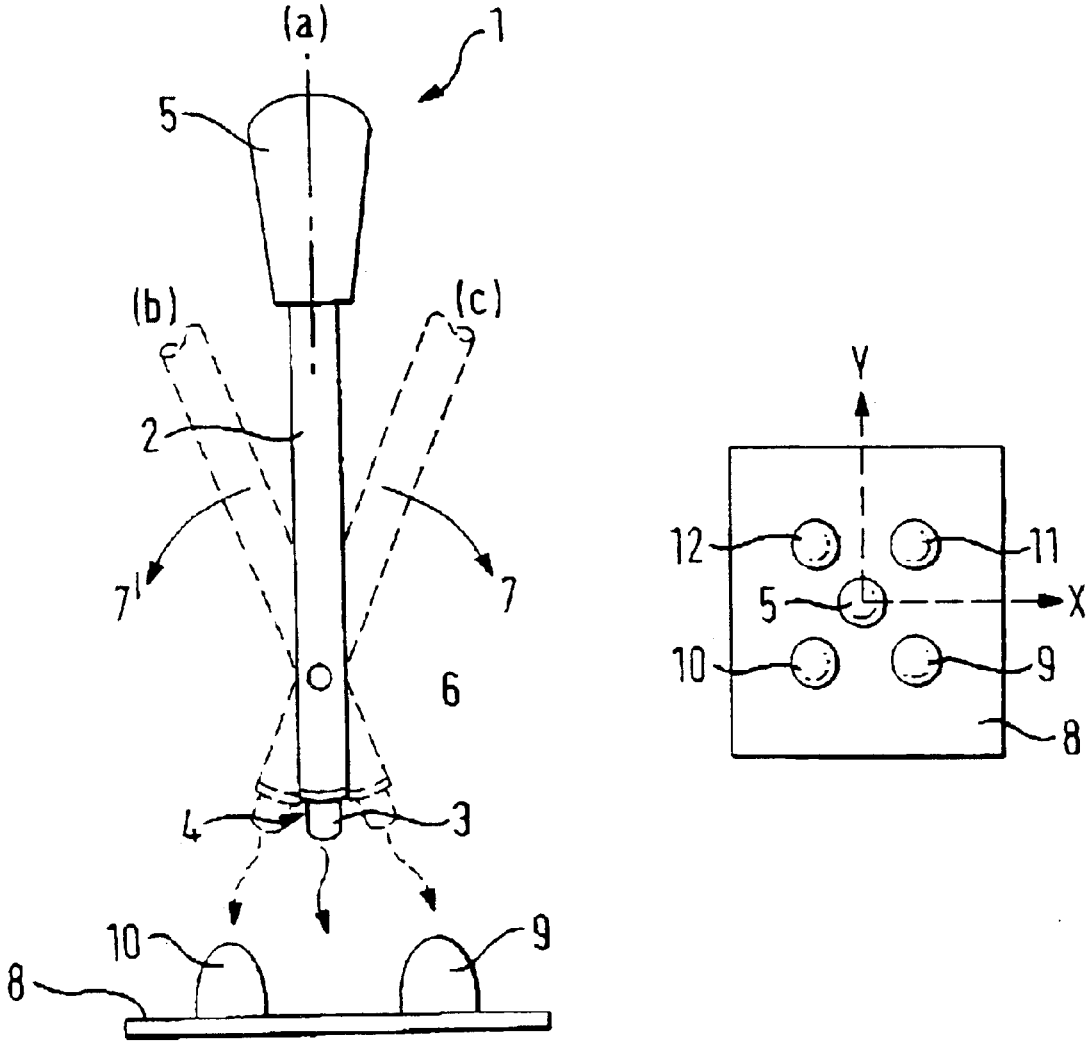
Figure 3:
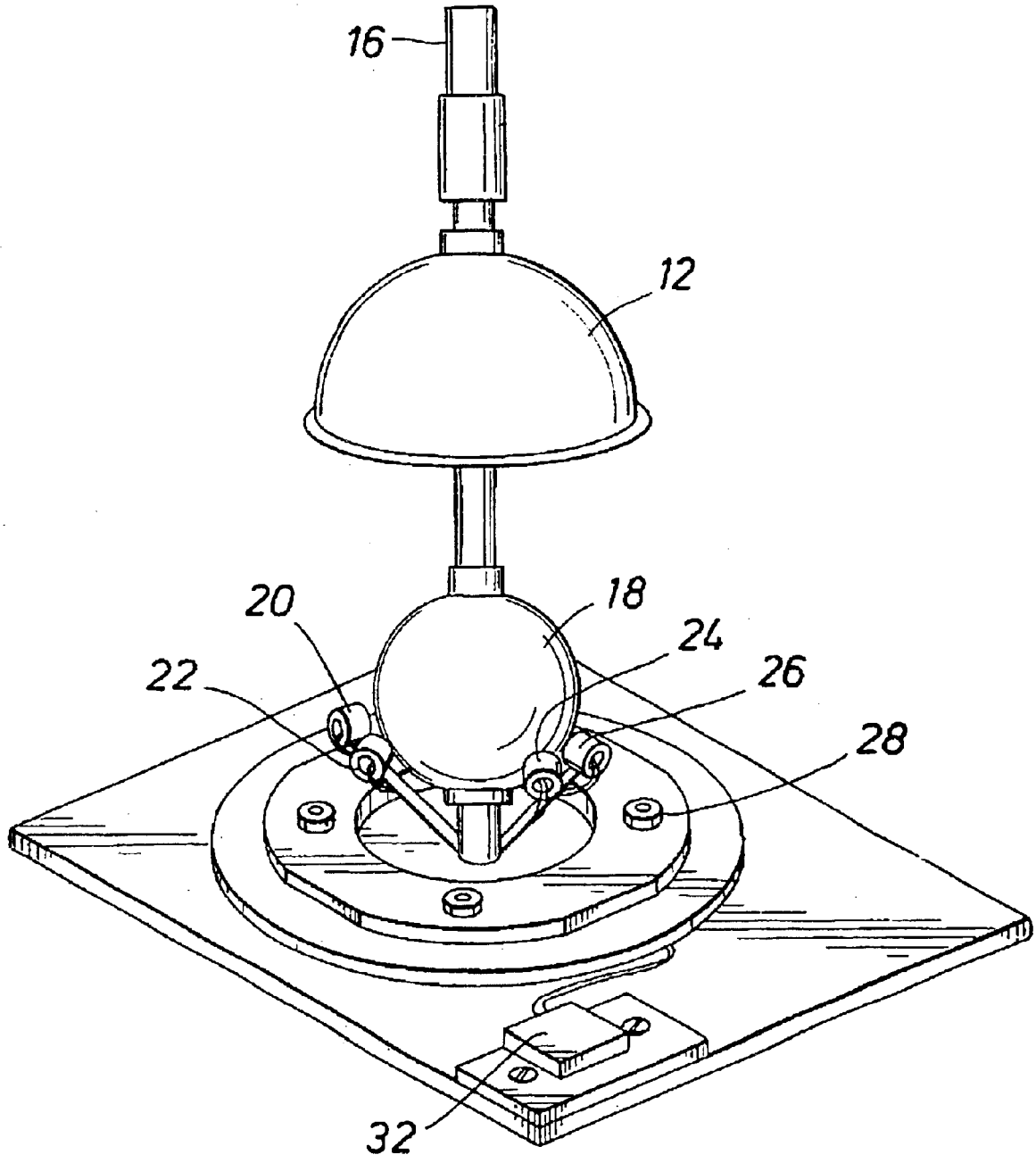
Fig. 3 (Prior Art)
Figure 4:
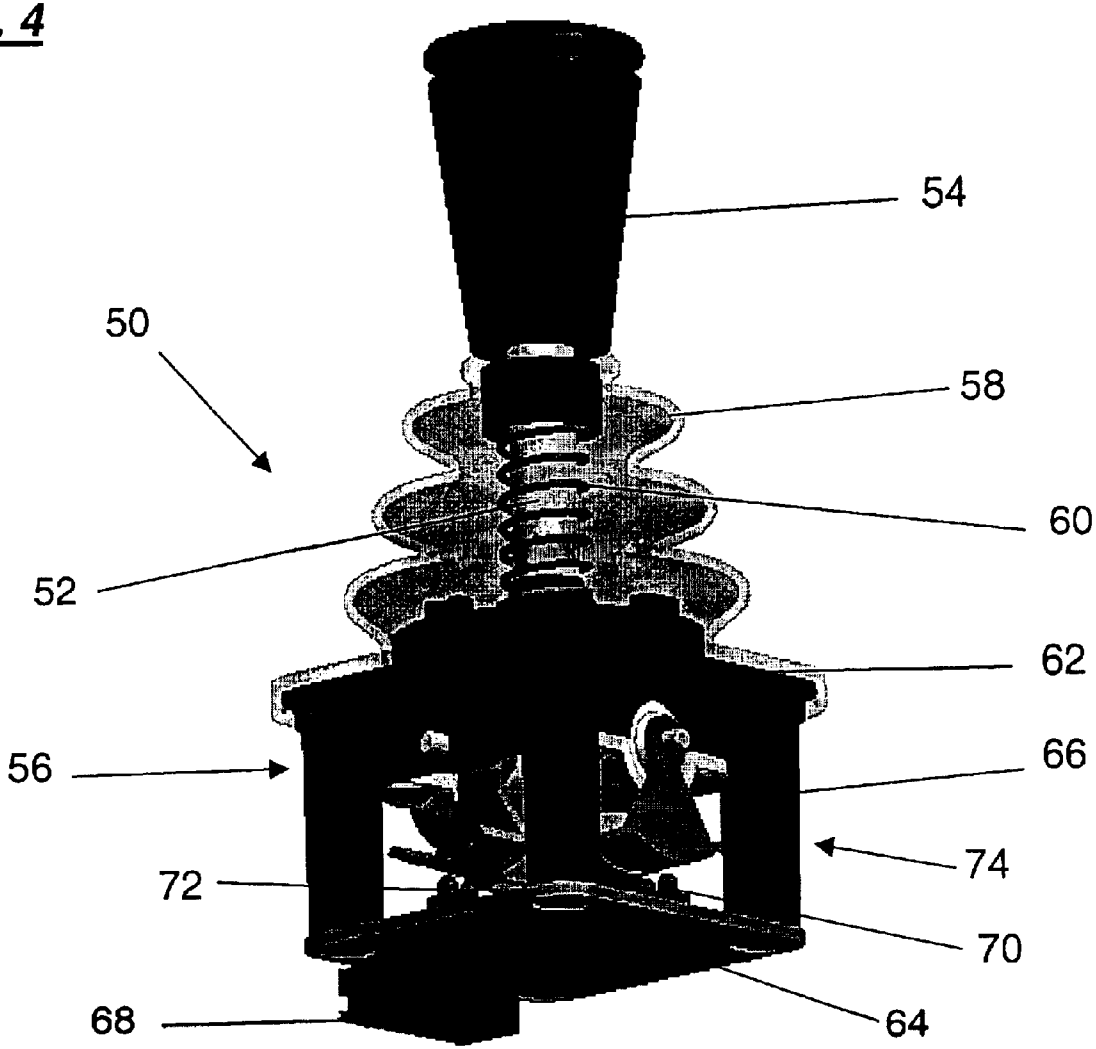
FIG. 4 is a schematic isometric view of a joystick in accordance with an embodiment of the invention.

FIG. 4 is a schematic isometric view of a joystick 50 in accordance with a presently preferred embodiment of the invention.

As shown, the joystick comprises a shaft 52 which is provided with a knob 54 at one end. The other end of the shaft extends into the interior of a housing 56, and provided between the knob and the housing is a dust jacket 58 which is provided to help reduce the amount of dust, dirt and other detritus which might otherwise get inside the housing 56.

Located about the shaft 52 outside of the housing 56 and within the jacket 58 is a spring 60 which functions to return the shaft to a roughly dead-centre position.

The housing 56 comprises a cage formed by an upper wall 62 which is connected to a lower wall 64 by four supporting pillars 66. The lower wall 64, in the preferred embodiment, comprises a printed circuit board to which sensing components (to be later described) are fixed and signals from the sensing components are output from the printed circuit board by means of an input/output interface 68.

The sensing components in the preferred embodiment comprise a first sensor assembly 70 for sensing movement of the shaft in an X axis direction and a second sensor assembly 72 for sensing movement of the shaft in a Y axis direction. Each sensor assembly 70, 72 comprises (as will later be described in detail) an optical emitter and an optical detector arranged so that light output from the optical emitter is reflected off a surface for detection by the optical detector. In the preferred embodiment, the surfaces for reflecting light each comprise an arcuate planar surface with a generally triangular or quadrant-shaped wall extending from one side thereof.

Provided within the housing 56 is mechanical linkage indicated generally by reference numeral 74 which functions to convert movement of the shaft 52 into corresponding movements of one or both of the aforementioned reflecting surfaces as appropriate.

Figure 5:
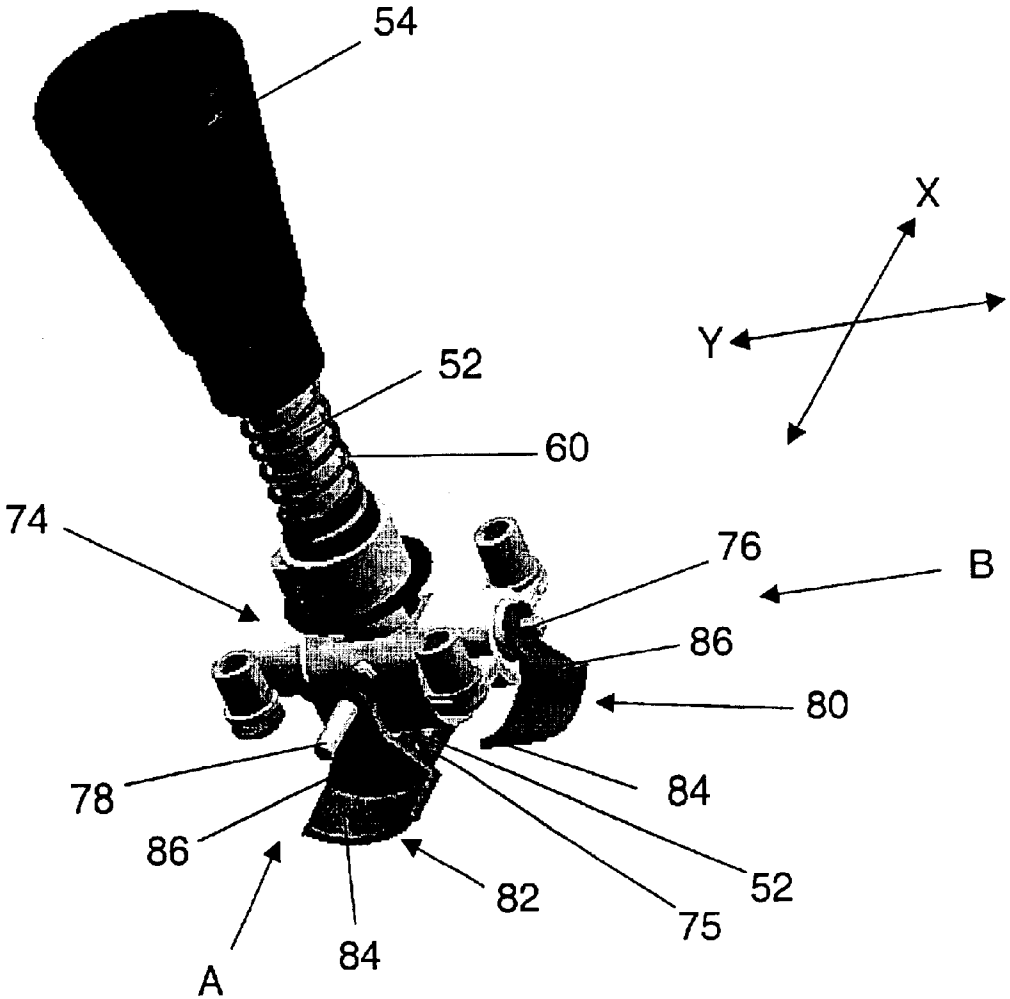
FIG. 5 is a schematic isometric view of principal components of the joystick shown in FIG. 4.

FIG. 5 is a schematic isometric view of the joystick 50 shown in FIG. 4 but with the housing 56 and dust jacket 58 removed.

As shown in FIG. 5, the joystick shaft 52 is coupled by an appropriate mechanical linkage 74 to an X axis reflector 80 and a Y axis reflector 82. The X axis reflector 80 is snugly mounted on an X axis shaft 76 for joint rotation therewith, and the Y axis reflector 82 is directly coupled to the shaft 52 by means of an extension 75 of the Y axis reflector 82 which is provided with a longitudinal generally rectangular slot that enables the extension to be fitted over the end of the shaft 52.

Broadly speaking, the mechanical linkage 74 (to be later described) functions to convert movement of the shaft 52 in an X direction (as indicated in FIG. 5) into a rotation of the X axis shaft 76 and X axis reflector 80 mounted thereon. Similarly, the mechanical linkage also functions to convert movement of the shaft 52 in a Y direction (also indicated in FIG. 5) into a rotation of the Y axis reflector 82 which is pivotally mounted on the housing 56 by means of a pivot pin 78.

As mentioned before, the X and Y axis reflectors each comprise a generally arcuate planar reflecting surface 84 which is provided with an upstanding generally triangular web 86 which is apertured so that it can be received on the X axis shaft 76 or pivot pin 78, as appropriate.

The undersides of each reflecting surface 84 (i.e. the sides facing away from the aforementioned connecting webs 86 are coated with light reflective material and the coating is arranged so that the reflectivity of the surface varies from being substantially reflective at one end of the surface to being substantially non-reflective at the other end of the surface.

As an example, if the aforementioned light emitters are infrared emitters then the reflecting surfaces could be graded from black to white along their longitudinal length. This arrangement would also prove workable if the light emitters where to emit visible white light.

The grading of the reflectivity of the surfaces can, in one embodiment of the invention, be smooth in that the rate of change of reflectivity is constant along the longitudinal length of the reflecting surface. Alternatively, in another preferred embodiment of the invention, the grading of the reflectivity along the length of the surface can be arranged so that the rate of change of reflectivity is not constant and instead varies non-lineally.

Providing a reflectivity which changes non-lineally can be advantageous in circumstances where a user of the joystick is only capable of relatively small hand movements, and hence relatively small movements of the shaft 52.

Figure 6:
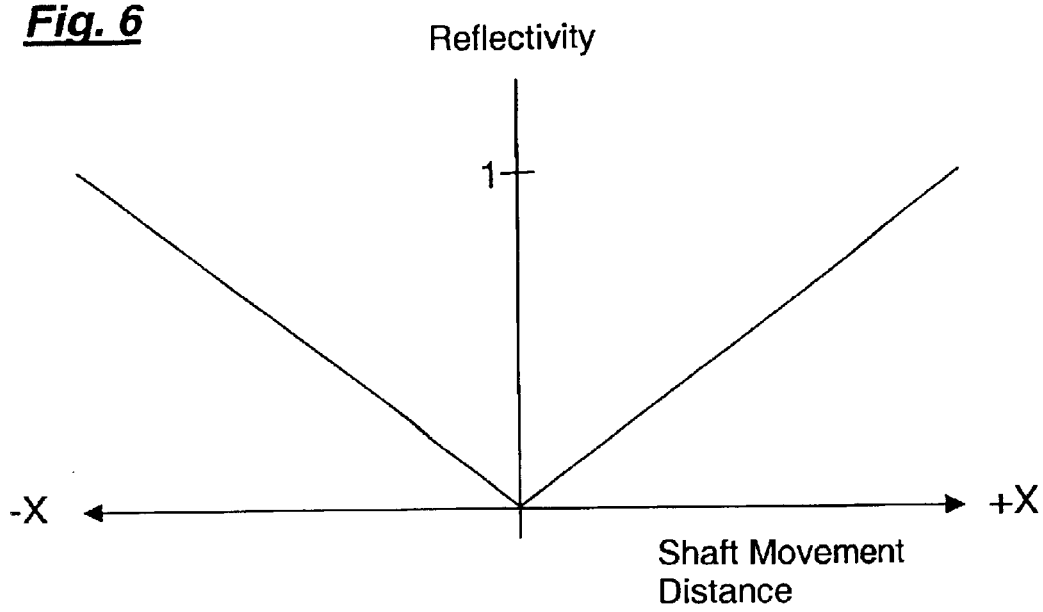
FIGS. 6 and 7 are schematic graphs of reflectivity versus Shaft Movement Distance.
Figure 7:
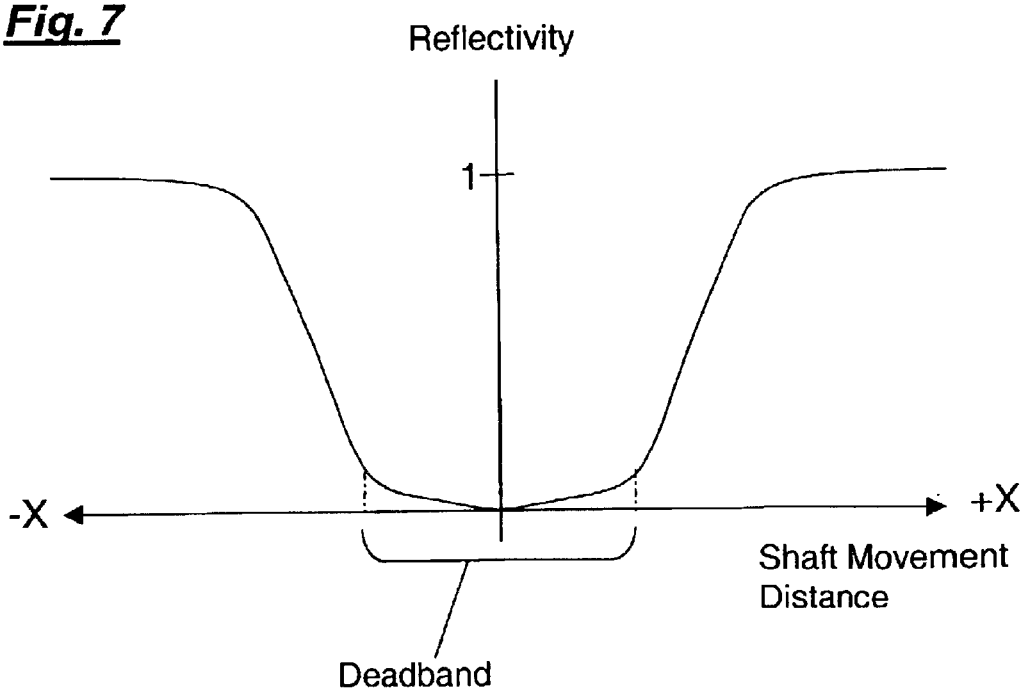

FIGS. 6 and 7 show representative graphs of reflectivity versus shaft movement distance either side of a centre point on the X axis.

In particular, FIG. 6 illustrates an arrangement where the reflectivity of the surface varies lineally (i.e. the rate of change of reflectivity is constant) along the length of the reflecting surface. FIG. 7, on the other hand, illustrates an arrangement where the reflectivity of the reflecting surfaces varies non-lineally (i.e. the rate of reflectivity change is not constant) along the length of the reflecting surface.

It can be seen by comparing FIGS. 6 and 7 that to attain a given reflectivity, say 0.75, the arrangement of FIG. 7 requires less joystick movement than the arrangement of FIG. 6. As a consequence the arrangement of FIG. 7 would be more appropriate for users who have some sort of physical disability which reduces the extent to which they can easily move their hands.

Another advantage of the particular arrangement shown in FIG. 7 is that the reflectivity changes relatively slowly for relatively small movements of the shaft from a notional centre point. This is advantageous in that it provides a central dead band in which a small shaft movement (such as that which might be caused by an involuntary hand movement or tremor) will have little effect upon the reflectivity of the surface.

The reflectivity's of each reflecting surface 84 can be arranged to change in a similar manner, or alternatively one surface can be arranged to have a change of reflectivity which is constant whilst the other surface has a non-lineally varying change of reflectivity.

Figure 9:
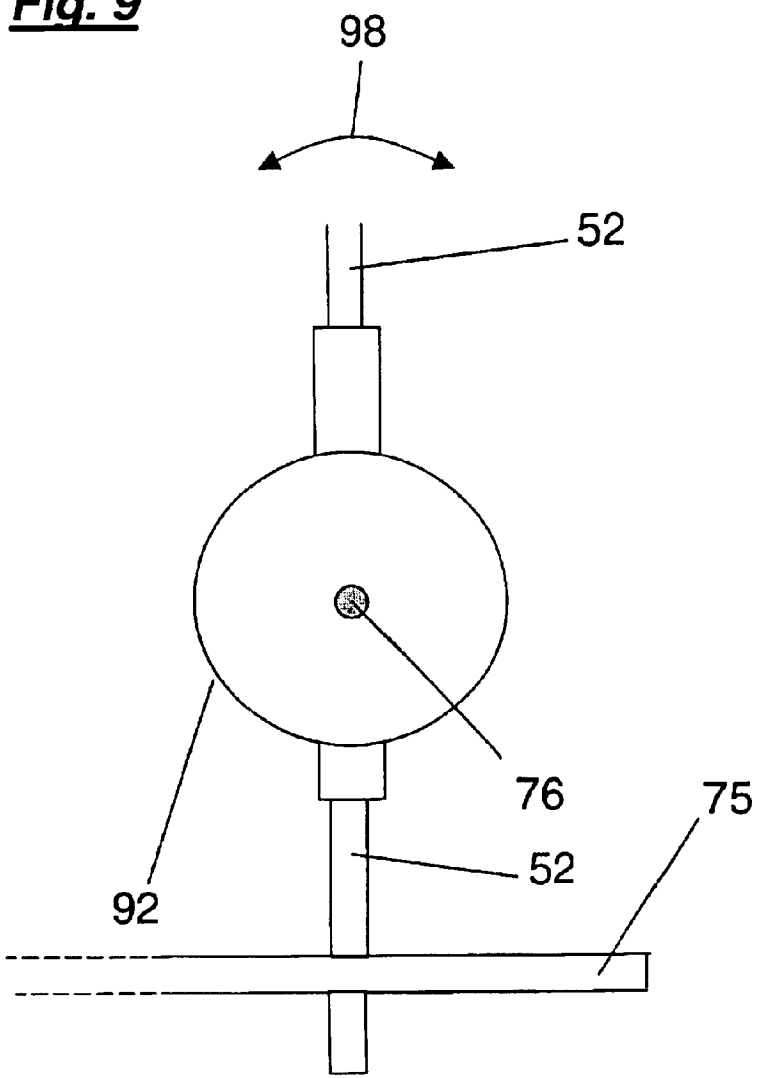
FIG. 9 is an elevation of the components shown in FIG. 5 as viewed in the direction "B" in FIG. 5.
Figure 8:
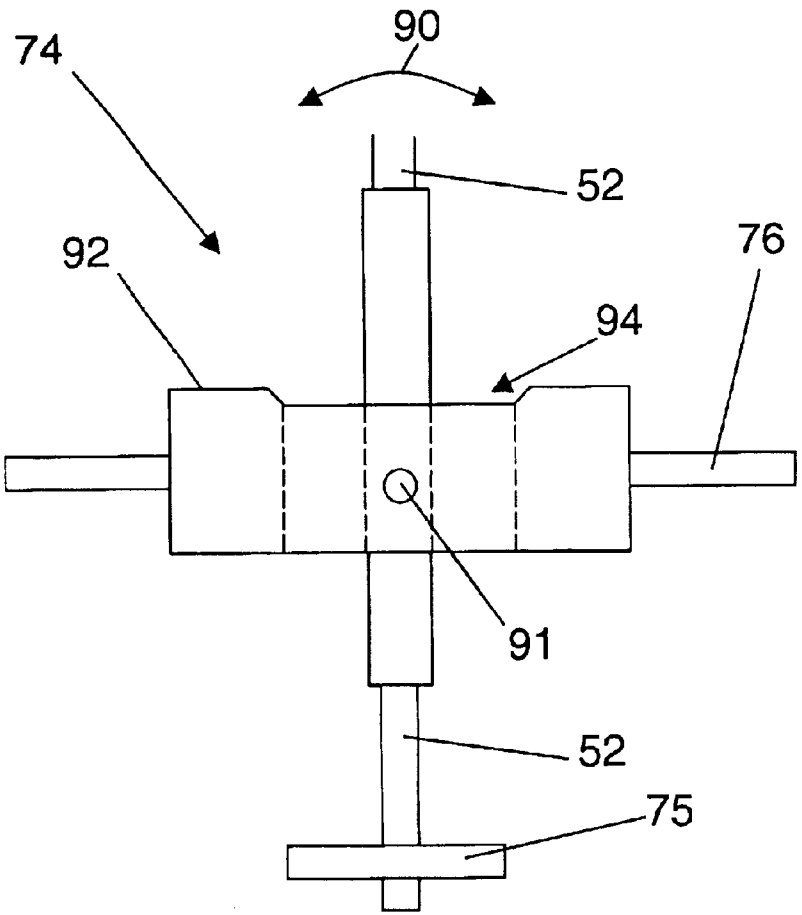
FIG. 8 is an elevation of the components shown in FIG. 5 as viewed in the direction "A" in FIG. 5.

FIGS. 8 and 9 provide a schematic illustration of the mechanical linkage 74 shown in FIGS. 4 and 5. In particular, FIG. 8 is a view of the linkage in a direction "A" shown in FIG. 5, and FIG. 9 is a view of the linkage in a direction "B" also shown in FIG. 5.

Referring firstly to FIG. 8, the shaft 52 is fitted in a longitudinal generally rectangular slot 94 that extends right through a generally cylindrical X axis sleeve 92 (as indicated by the dotted lines in FIG. 8). The shaft 52 is connected to the sleeve 92 by means of a pivot pin 91 which extends, although not visible in FIG. 8, from one side of the sleeve through a bore in the shaft 52 and out the other side of the sleeve. Movement of the shaft 52 in a Y direction 90 causes the shaft 52 to pivot about the pin 91 and a portion of the shaft 52 extending below the sleeve 92 to drive the aforementioned extension 75 of the Y axis reflector 82 (and hence to rotate the Y axis reflector about the pivot 78).

FIG. 9 is a view in direction "B" of FIG. 5 and illustrates the X axis shaft 76 which, in the preferred embodiment, is formed as an extension of the above described X axis sleeve 92 (for example by machining the generally cylindrical sleeve to reduce its cross-sectional area). Movement of the shaft 52 back and forth in a direction 98 will cause the shaft 52 (as shown in FIG. 8) to abut against the edges of the longitudinal slot 94 and hence will cause the X axis sleeve 92 and X axis shaft 76 to rotate in unison with movement of the shaft 52 in the aforementioned direction 98. Since the Y axis reflector extension 75 is longitudinally slotted, a movement of the shaft in direction 98 only will not drive the extension 75, and thus will not cause the Y axis reflector 82 to pivot about pivot pin 78.

In operation, movement of the shaft 52 in the X direction 98 will give rise to a rotation of the X axis shaft 76. Rotation of the X axis shaft will causes a corresponding rotation of the X axis reflector, and as the reflector moves so the reflectivity of the reflective surface 84 immediately opposite the emitter of the X axis sensor assembly 70 will change. Light emitted from the emitter of the X axis sensor assembly 70 is detected by the detector of the assembly and converted into a voltage signal which varies in magnitude in dependence upon the intensity of light detected, upon the portion of the reflective surface 84 illuminated by the emitter, and hence upon the position of the shaft 52 in the X axis.

Movement of the shaft 52 in the Y direction 90 causes the shaft to pivot in the slot 94 about the pivot pin 91, and causes the part of the shaft 52 extending below the X axis sleeve 92 to directly drive the Y axis reflector extension 75, and hence to rotate the Y axis reflector 82 about the pivot axis 78. As the Y axis reflector 82 is pivoted a change in voltage level is detected by the Y axis sensor assembly 72.

Movement of the shaft in both the X and Y directions results in voltage level changes at each of the sensor assemblies 70, 72 which are indicative of the position of the shaft 52.

As mentioned above, the preferred embodiment of the present invention (as described above) provides a number of advantages over the joysticks of the prior art. In particular, it is surprising that (given the general aim in the art of simplifying joystick construction) a complication of the joystick construction to include two reflectors actually leads to a simplification of the joystick as a whole.

It will be understood that embodiments of the invention have been described above by way of example only, and that modifications may be made within the spirit and scope of the invention.

For example, whilst it is mentioned above that the reflective surfaces are coated with reflective material it will be apparent that the surfaces could instead simply be painted with different shades of paint to achieve the same effect. It will also be apparent to persons skilled in the art that the particular arrangement of the sensor assemblies and associated reflectors may be reversed without departing from the scope of the invention. In such an arrangement the emitter and detector pairs would be carried and pivoted by appropriate mechanical linkage and the two reflectors would be stationary on the lower wall 64 of the housing 56.

As another example, it will be appreciated that whilst it is preferred for the reflective surfaces to be arcuate (to maintain a roughly constant distance between the emitter and the reflective surface) this may not actually be required, and thus that the reflective surfaces may be flat or have any other profile.

It will also be apparent that any of a number of different light sources may be provided as the emitter of each sensor assembly. For example, the emitters could be white light emitters, infra-red LED (light emitting diode) emitters or any other type of emitter.

If the emitters are chosen to be infrared emitters then the present invention may also make use of the temperature compensation circuitry disclosed in the aforementioned UK Patent Application No. 2334573.

What is claimed is:

1. A joystick comprising:

a control shaft;

a first reflecting surface, said surface having a reflectivity that varies along a notional line on said first surface;

a second reflecting surface, said surface having a reflectivity that varies along a notional line on said second surface;

a first sensor assembly comprising a first emitter operable to illuminate said first reflecting surface along said notional line with radiation, and a first detector arranged to detect radiation emitted by said first emitter and reflected by said first reflecting surface; and a second sensor assembly comprising a second emitter operable to illuminate said second reflecting surface along said notional line with radiation, and a second detector arranged to detect radiation emitted by said second emitter and reflected by said second reflecting surface;

wherein movement of said shaft provides a relative movement between emitters of the first and/or second sensor assemblies and respective associated reflecting surfaces to vary the intensity of radiation reflected, and said detectors of said first and second sensor assemblies are each operable to output a voltage that is dependent on the intensity of radiation detected.

2. A joystick according to claim 1, wherein at least one of said first and second reflecting surfaces have a reflectivity that varies linearly (i.e. with a constant change in reflectivity) along said notional line on said surface.

3. A joystick according to claim 1, wherein at least one of said first and second reflecting surfaces have a reflectivity that varies non-linearly (i.e. with a varying change in reflectivity) along said notional line on said surface.

4. A joystick according to claim 2, wherein both of said first and second reflecting surfaces have a reflectivity that varies linearly (i.e. with a constant change in reflectivity) along said notional line on said surface.

5. A joystick according to claim 3, wherein both of said first and second reflecting surfaces have a reflectivity that varies non-linearly (i.e. with a varying change in reflectivity) along said notional line on said surface.

6. A joystick according to claim 1, wherein said first and second reflective surfaces are provided on first sides of first and second reflectors respectively, said reflectors being generally rectangular with said notional lines extending in parallel to a longitudinal axis of each said rectangular reflector.

7. A joystick according to claim 6, wherein each of said first and second rectangular reflectors are shaped to maintain a generally constant spacing between respective reflective surfaces and emitters upon relative movement between the reflectors and associated sensor assemblies.

8. A joystick according to claim 7, wherein said first and second rectangular reflectors are curved so as to be generally arcuate in profile.

9. A joystick according to claim 6, wherein said first reflector comprises:

a web extending outwardly from a surface of the rectangular reflector opposite said first reflective surface, said web being provided with a bore to permit said first reflector to be pivotally mounted on a pivot pin connected to a housing of the joystick, and an arm extending generally transversely from said first rectangular reflector, said arm being provided with a generally rectangular longitudinal slot to permit said arm to be fitted over said control shaft;

wherein said longitudinal slot is arranged to cause said first reflector to pivot about said pivot pin upon movement of said shaft in one axis and to cause said first reflector not to pivot about said pivot pin upon movement of said shaft in a second axis perpendicular to said first axis.

10. A joystick according to claim 9, wherein said second reflector comprises a web extending outwardly from a surface of the rectangular reflector opposite said second reflective surface, said web being provided with a bore to permit said second reflector to be pivotally mounted on a pivot axle operable to convert movement of said control shaft into movement of said second reflector.

11. A joystick according to claim 9, wherein each said web is generally triangular or quadrant shaped in profile.

12. A joystick according to claim 10, wherein said pivot axle comprises:

a generally cylindrical sleeve having a generally rectangular slot therethrough, said slot being sized to permit the control shaft to pass through the sleeve for engagement with said arm of said first reflector, and a pivot pin for retaining the shaft within the slot;

wherein movement of said shaft in a direction generally parallel to a longitudinal axis of said slot causes the shaft to pivot about said pivot pin to directly drive the first reflector; and movement of said shaft in a direction generally perpendicular to a longitudinal axis of said slot causes said shaft to abut against a longitudinal wall of said slot to rotate the pivot axle.

13. A joystick according to claim 1, wherein said emitters of said first and second assemblies comprise infrared light emitting diodes.

14. A joystick comprising:

a control shaft;

a first reflecting surface, said first reflecting surface having a reflectivity that varies along a notional line on said first surface;

a second reflecting surface, said second reflecting surface having a reflectivity that varies along a notional line on said second surface;

a first sensor assembly comprising a first emitter operable to illuminate said first reflecting surface along said notional line with radiation, and a first detector arranged to detect radiation emitted by said first emitter and reflected by said first reflecting surface; and a second sensor assembly comprising a second emitter operable to illuminate said second reflecting surface along said notional line with radiation, and a second detector arranged to detect radiation emitted by said second emitter and reflected by said second reflecting surface;

wherein:

movement of said shaft in an X direction provides a relative movement between emitters of the first sensor assembly and said first reflecting surfaces to vary the intensity of radiation reflected, movement of said shaft in an Y direction provides a relative movement between emitters of the second sensor assembly and said second reflecting surfaces to vary the intensity of radiation reflected, and said detectors of said first and second sensor assemblies are each operable to output a voltage that is dependent on the intensity of radiation detected.

15. A joystick according to claim 14, further comprising a base to which said first and second sensor assemblies are immovably fixed.

16. A joystick according to claim 15, wherein each of said first and second reflecting surfaces are mounted for pivotal movement about first and second axes respectively, movement of said shaft in said X direction causing said first reflecting surface to pivot about said first axis, and movement of said shaft in said Y direction causing said second reflecting surface to pivot about said second axis.

* * * * *